US009041506B2

(12) United States Patent
Kim et al.

(10) Patent No.: US 9,041,506 B2
(45) Date of Patent: May 26, 2015

(54) MULTILAYER INDUCTOR AND METHOD OF MANUFACTURING THE SAME

(75) Inventors: Myeong Gi Kim, Gyeonggi-do (KR); Sung Yong An, Gyeonggi-do (KR); Soo Hwan Son, Seoul (KR)

(73) Assignee: SAMSUNG ELECTRO-MECHANICS CO., LTD., Suwon, Gyunggi-Do (KR)

( * ) Notice: Subject to any disclaimer, the term of this patent is extended or adjusted under 35 U.S.C. 154(b) by 102 days.

(21) Appl. No.: 13/487,568

(22) Filed: Jun. 4, 2012

(65) Prior Publication Data

US 2013/0027168 A1 Jan. 31, 2013

(30) Foreign Application Priority Data

Jul. 29, 2011 (KR) ..... 10-2011-0076058

(51) Int. Cl.
*H01F 5/00* (2006.01)
*H01F 27/28* (2006.01)

(52) U.S. Cl.
CPC ..... *H01F 27/28* (2013.01); *H01F 2027/2809* (2013.01); *Y10T 29/4902* (2015.01)

(58) Field of Classification Search
USPC ..... 336/200, 232, 83
IPC ..... H01F 5/00
See application file for complete search history.

(56) References Cited

U.S. PATENT DOCUMENTS

| | | | | |
|---|---|---|---|---|
| 7,889,044 | B2 * | 2/2011 | Ueda et al. | 336/200 |
| 2004/0084131 | A1 * | 5/2004 | Konoue et al. | 156/89.11 |
| 2011/0152725 | A1 * | 6/2011 | Demir et al. | 600/587 |
| 2012/0013429 | A1 * | 1/2012 | Kim et al. | 336/200 |

FOREIGN PATENT DOCUMENTS

| | | | |
|---|---|---|---|
| JP | 06-120065 | | 4/1994 |
| JP | 11135328 | A | 5/1999 |
| JP | 2004080023 | A | 3/2004 |
| JP | 2005136008 | A | 5/2005 |

(Continued)

OTHER PUBLICATIONS

Japanese Office Action issued in Japanese Patent Application No. 2012-134538 mailed Sep. 10, 2013.

(Continued)

*Primary Examiner* — Tuyen Nguyen
(74) *Attorney, Agent, or Firm* — McDermott Will & Emery LLP

(57) ABSTRACT

Disclosed herein are a multilayer power inductor and a method of manufacturing the same. The multilayer power inductor includes a multilayer body formed by multi-layering a plurality of body sheets; a coil portion including internal electrode patterns that are respectively formed on the plurality of body sheets; and external electrodes that are disposed on lateral surfaces of the multilayer body and are electrically connected to both ends of the coil portion, wherein a space portion is formed in the internal electrode pattern to correspond to contraction of the plurality of body sheet. The multilayer power inductor relieves internal stress generated in a product through the space portion so as to prevent the body sheet from being magnetized due to the internal stress, thereby preventing a reduction in inductance. The multilayer inductor may also be manufactured by using conventional manufacturing processes themselves without any influence on the productivity of a product.

3 Claims, 2 Drawing Sheets

(56) References Cited

FOREIGN PATENT DOCUMENTS

| | | | | |
|---|---|---|---|---|
| JP | 2005-159301 | A | | 6/2005 |
| JP | 2008021788 | A | * | 1/2008 |
| KR | 2004-0047452 | A | | 6/2004 |
| WO | 2012144103 | A1 | | 10/2012 |

OTHER PUBLICATIONS

Korean Office Action for Application No. 10-2011-0076058 dated Jun. 26, 2012.
Korean Notice of Allowance for Application No. 10-2011-0076058 dated Nov. 29, 2012.

* cited by examiner

MULTILAYER INDUCTOR AND METHOD OF MANUFACTURING THE SAME

CROSS REFERENCE(S) TO RELATED APPLICATIONS

This application claims the benefit under 35 U.S.C. Section 119 of Korean Patent Application Serial No. 10-2011-0076058, entitled "Multilayer Inductor and Method of Manufacturing the Same" filed on Jul. 29, 2011, which is hereby incorporated by reference in its entirety into this application.

BACKGROUND OF THE INVENTION

1. Technical Field

The present invention relates to a multilayer inductor, and more particularly, to a multilayer inductor including a coil portion formed by multi-layering a plurality of body sheets on which an internal electrode is printed, and a method of manufacturing the same.

2. Description of the Related Art

A multilayer inductor is mainly used in a power circuit such as a DC-DC converter of a portable device. In this regard, research has been conducted on miniaturization, a high current, low DC resistance, or the like of multilayer inductors. Recently, due to the development of high frequency and miniaturization of a DC-DC converter, multilayer inductors have been increasingly used instead of conventional wound choke coils.

However, in a structure such as a multilayer inductor in which a body sheet formed of ferrite and an internal electrode are integrated with each other, internal stress is generated due to a thermal expansion coefficient difference between the body sheet and the internal electrode during sintering and cooling processes of manufacturing processes.

Since ferrite has magnetostrictive properties, the body sheet formed of ferrite is partially magnetized due to internal stress. Since an electron spin is fixed in a magnetized portion of the body sheet, a direction of the spin direction is not changed when an alternating current (AC) is supplied to the body sheet. Thus, permeability with respect to a magnetic field is reduced, thereby reducing inductance.

In addition, recently, since electronic components have been rapidly miniaturized, a volume ratio of an internal electrode to an electronic component such as a multilayer inductor has increased. Accordingly, internal stress is increased and inductance is seriously reduced due to the internal stress.

SUMMARY OF THE INVENTION

An object of the present invention is to provide a multilayer inductor and a method of manufacturing the same, which relieve internal stress generated in a product during sintering and cooling processes of the multilayer inductor, thereby preventing a reduction in inductance.

According to an exemplary embodiment of the present invention, there is provided a multilayer inductor, including a multilayer body formed by multi-layering a plurality of body sheets; a coil portion including internal electrode patterns that are respectively formed on the plurality of body sheets; and external electrodes that are disposed on both lateral surfaces of the multilayer body and are electrically connected to both ends of the coil portion, wherein a space portion is formed in the internal electrode pattern to correspond to contraction of the plurality of body sheets.

In addition, one or more space portions may be formed and the space portion may have a rectangular parallelepiped shape.

The multilayer inductor may further include a gap layer that is inserted between the plurality of body sheets and is formed of a non-magnetic material.

According to another exemplary embodiment of the present invention, there is provided a method of manufacturing a multilayer inductor, the method including: positioning a pattern mask having a shape corresponding to an internal electrode including a space portion on a body sheet; forming an internal electrode pattern on the body sheet through the pattern mask; multi-layering the plurality of body sheets; and forming external terminals on both lateral surfaces of the plurality of multi-layered body sheets.

The method may further include inserting a gap layer between the plurality of multi-layered body sheets.

DESCRIPTION OF THE PREFERRED EMBODIMENTS

Hereinafter, exemplary embodiments of the present invention will be described with reference to the accompanying drawings. However, the exemplary embodiments are described by way of examples only and the present invention is not limited thereto.

In describing the present invention, when a detailed description of well-known technology relating to the present invention may unnecessarily make unclear the spirit of the present invention, a detailed description thereof will be omitted. Further, the following terminologies are defined in consideration of the functions in the present invention and may be construed in different ways by the intention of users and operators. Therefore, the definitions thereof should be construed based on the contents throughout the specification.

As a result, the spirit of the present invention is determined by the claims and the following exemplary embodiments may be provided to efficiently describe the spirit of the present invention to those skilled in the art.

Figure 1:
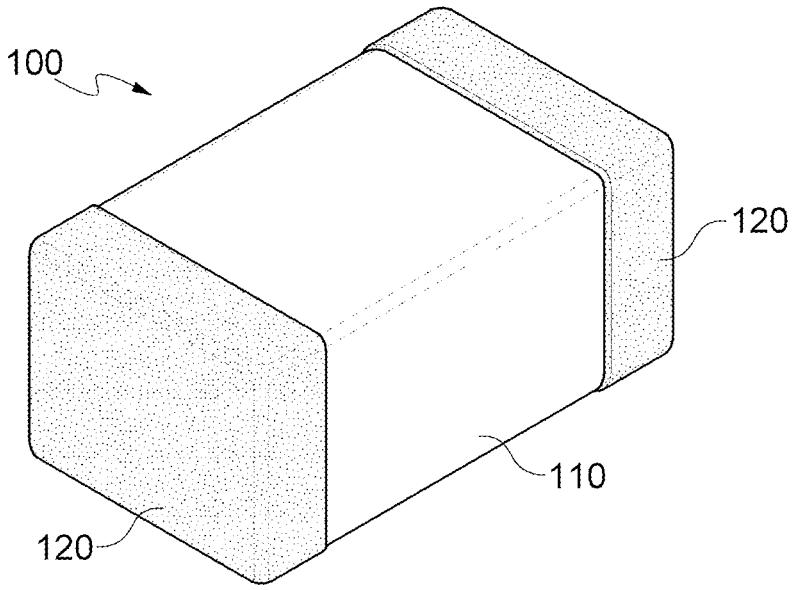
FIG. 1 is a perspective view of a multilayer inductor according to an embodiment of the present invention.
Figure 2:
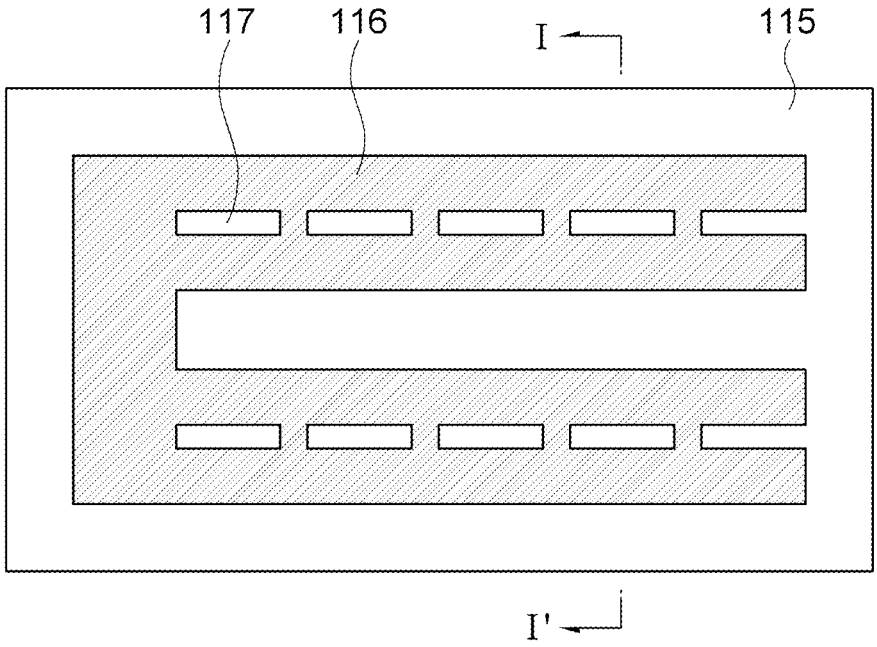
FIG. 2 is a top view showing an internal electrode pattern according to an embodiment of the present invention.
Figure 3:
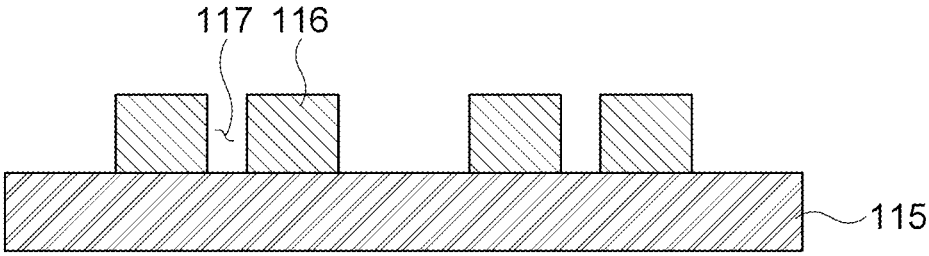
FIG. 3 is a cross-sectional view showing the internal electrode pattern taken along a line I-I' of FIG. 2, according to an embodiment of the present invention.

FIG. 1 is a perspective view of a multilayer inductor 100 according to an embodiment of the present invention. FIG. 2 is a top view showing an internal electrode pattern 116 according to an embodiment of the present invention. FIG. 3 is a cross-sectional view showing the internal electrode pattern 116 taken along a line I-I' of FIG. 2, according to an embodiment of the present invention. Referring to FIGS. 1 through 3, the multilayer inductor 100 includes a multilayer body 110, a coil portion, and external electrodes 120.

The multilayer body 110 is formed by multi-layering a plurality of body sheets 115 formed of ferrite. In general, ferrite is a magnetic material similar ceramic. Since ferrite has high permeability with respect to a magnetic field and high electric resistance, ferrite is used in various electronic components.

The body sheet 115 is formed as a thin plate type. The internal electrode pattern 116 is formed on an upper surface of the body sheet 115. A plurality of internal electrode patterns 116 are combined in up and down direction by multi-layering a plurality of body sheets 115. A coil portion is formed by combining the internal electrode patterns 116.

In addition, the external electrodes 120 are disposed on lateral surfaces of the multilayer body 110 and are electrically connected to both ends of the coil portion. The coil portion disposed in the multilayer body 110 is electrically connected to an external element through the external electrodes 120.

As shown in FIGS. 2 and 3, space portions 117 are formed in the internal electrode pattern 116. The space portions 117 absorb internal stress that is generated due to a thermal expansion coefficient difference between the body sheet 115 and the internal electrode pattern 116 during sintering and cooling processes to relieve the internal stress.

Figure 4:
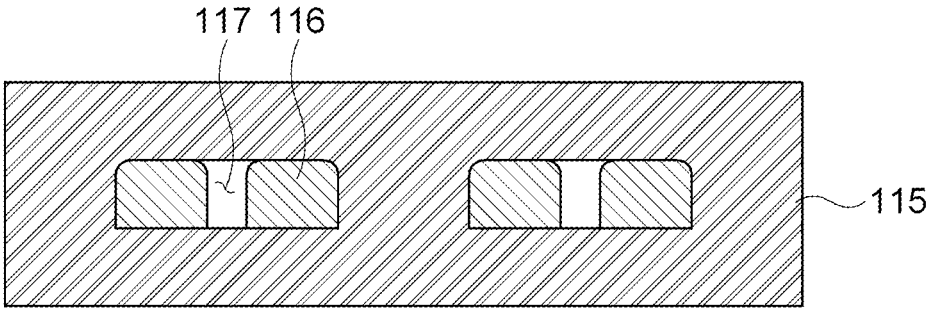
FIG. 4 is a cross-sectional view showing a case where a body sheet is multilayered on an internal electrode pattern, according to an embodiment of the present invention.

FIG. 4 is a cross-sectional view showing a case where the body sheet 115 is multilayered on the internal electrode pattern 116, according to an embodiment of the present invention. Referring to FIG. 4, the internal electrode pattern 116 is formed on an upper surface of the body sheet 115 and the body sheet 115 is multilayered on an upper surface of the internal electrode pattern 116 again such that the internal electrode pattern 116 is surrounded by the body sheet 115.

In this case, a width of the space portion 117 is determined as long as the body sheet 115 does not penetrate into the space portion 117. Thus, although the body sheet 115 is multilayered, a predetermined space may be ensured.

Figure 5:
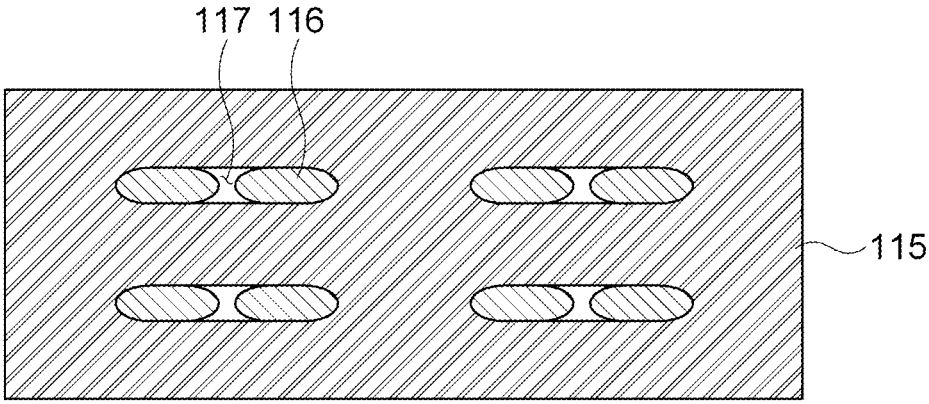
FIG. 5 is a cross-sectional view showing a case of when a sintering process is performed, according to an embodiment of the present invention.

FIG. 5 is a cross-sectional view showing a case of when a sintering process is performed, according to an embodiment of the present invention. As shown in FIG. 5, the internal electrode pattern 116 is compressed due to contraction of the body sheet 115 to generate internal stress. The internal stress is absorbed by the compressed space portions 117 while compressing the space portions 117.

As such, the multilayer inductor 100 relieves internal stress while the space portions 117 formed in the internal electrode pattern 116 are compressed. Thus, the body sheet 115 may be prevented from being magnetized due to the internal stress, thereby preventing inductance from being reduced.

In addition, one or more space portions 117 may be formed. In particular, the one or more space portions 117 may be uniformly distributed in the internal electrode pattern 116. Thus, the internal stress may be prevented from being generated more at one side and may be uniformly absorbed and distributed.

The space portion 117 may have a rectangular parallelepiped shape. Since the internal electrode pattern 116 has a rectangular shape, the space portion 117 is formed to have a rectangular parallelepiped shape corresponding to the internal electrode pattern 116. Accordingly, although the space portions 117 are compressed, deformation of the internal electrode pattern 116 may be minimized.

In addition, the multilayer inductor 100 may further include a gap layer (not shown). The gap layer may be formed of a non-magnetic material and may be inserted between the body sheets 115 so as to shield magnetic flux, thereby reducing a change rate of inductance.

Hereinafter, a method of manufacturing a multilayer inductor according to an embodiment of the present invention will be described.

The method of manufacturing a multilayer inductor according to the present embodiment includes preparing a pattern mask having a shape corresponding to an internal electrode including a space portion and positioning the pattern mask on a body sheet. In addition, an internal electrode pattern is formed on the body sheet through the pattern mask and then the pattern mask is removed.

Then, a plurality of body sheets each including the internal electrode pattern are multi-layered to form a coil portion and then external terminals are formed on both lateral surfaces of the multi-layered body sheet, thereby completing the manufacture of a product.

According to the method of manufacturing a multilayer inductor according to the present embodiment, the space portion may be formed together with the internal electrode pattern by simply changing a shape of the pattern mask, and thus, a separate process is not required to form the space portion.

Thus, a multilayer inductor according to the present embodiment may be manufactured by using conventional manufacturing processes themselves without any influence on the productivity of a product.

In addition, the method of manufacturing a multilayer inductor according to the present embodiment may further include inserting a gap layer between multi-layered body sheets. As described above, the gap layer may be formed of a non-magnetic material and may be inserted between the body sheets so as to shield magnetic flux, thereby reducing a change rate of inductance.

According to a multilayer inductor and a method of manufacturing the same according to the present invention, a body sheet is prevented from being magnetized due to internal stress generated within a product, thereby preventing a reduction in inductance.

In addition, a multilayer inductor may be manufactured by using conventional manufacturing processes themselves without any influence on the productivity of a product.

While this invention has been particularly shown and described with reference to embodiments thereof, it will be understood by those skilled in the art that various changes in form and details may be made therein without departing from the spirit and scope of the invention as defined by the appended claims. The embodiments should be considered in a descriptive sense only and not for purposes of limitation.

Therefore, the scope of the invention is defined not by the detailed description of the invention but by the appended claims, and all differences within the scope will be construed as being included in the present invention.

What is claimed is:

1. A multilayer inductor, comprising:

a multilayer body formed by multi-layering a plurality of body sheets;

a coil portion including internal electrode patterns that are respectively formed on the plurality of body sheets; and external electrodes that are disposed on both lateral surfaces of the multilayer body and are electrically connected to both ends of the coil portion, wherein a space portion is formed in the internal electrode pattern to correspond to contraction of the plurality of body sheets and an inside of the space portion is not filled with material of the body sheets.

2. The multilayer inductor according to claim 1, wherein one or more space portions are formed.

3. The multilayer inductor according to claim 1, wherein the space portion has a rectangular parallelepiped shape.

* * * * *